United States Patent [19]

Probsteder

[11] 4,218,980

[45] Aug. 26, 1980

[54] FURNACE ESPECIALLY WELL SUITED FOR BURNING STRAW, WOOD WASTE MATERIALS AND THE LIKE

[76] Inventor: Josef Probsteder, Bachanger 14, 8399 Ruhstorf, Fed. Rep. of Germany

[21] Appl. No.: 893,414

[22] Filed: Apr. 4, 1978

[30] Foreign Application Priority Data

May 11, 1977 [DE] Fed. Rep. of Germany ..... 2721213

[51] Int. Cl.[2] ..... F23G 9/00

[52] U.S. Cl. ..... 110/196; 110/116; 110/210; 110/256

[58] Field of Search ..... 110/160, 256, 196, 224, 110/204, 223, 225, 227, 228, 116, 210

[56] References Cited

U.S. PATENT DOCUMENTS

| | | | |
|---|---|---|---|
| 2,397,870 | 4/1946 | Kneass, Jr. | 110/160 |
| 2,978,997 | 4/1961 | Pierce | 110/223 |
| 3,031,982 | 5/1962 | Gordon et al. | 110/116 |
| 3,344,758 | 10/1967 | Wotschke | 110/227 |
| 3,592,151 | 7/1971 | Webber | 110/228 |
| 3,861,332 | 1/1975 | Itasaka | 110/227 |
| 3,961,587 | 6/1976 | Ozawa | 110/160 |

*Primary Examiner*—Edward G. Favors
*Attorney, Agent, or Firm*—Stevens, Davis, Miller & Mosher

[57] ABSTRACT

A furnace adapted for burning waste materials such as straw, brushwood or the like has a cylindrical housing enclosing a combustion chamber and a hopper above the chamber for supplying fuel thereto. A slidable partition member separates the hopper from the combustion chamber. A suction tube having a constriction in its wall to reduce the cross-section of the tube is provided to withdraw combustion gases from the combustion chamber. A conduit connected to a source of compressed air terminates in a nozzle disposed in the suction tube to direct compressed air in the direction of the flow of gases from the combustion chamber. Pillers are provided in the chamber to support a bale of straw or other fuel material.

11 Claims, 2 Drawing Figures

Figure 1:
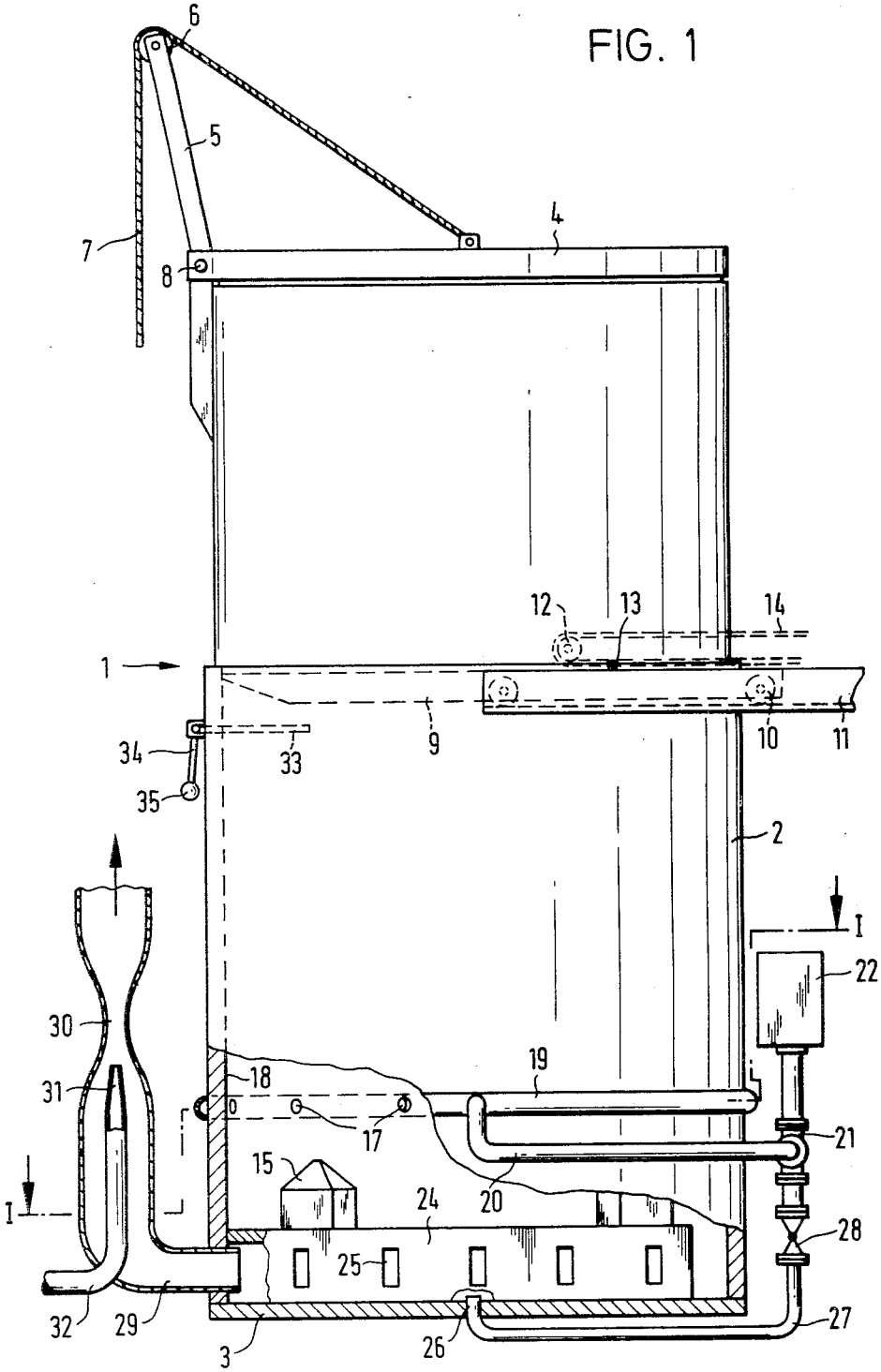

FURNACE ESPECIALLY WELL SUITED FOR BURNING STRAW, WOOD WASTE MATERIALS AND THE LIKE

This invention relates to a furnace for burning waste fuel such as straw or waste wood products.

Straw has a caloric value of about 3,400 kcal/kg, that is to say one kg of straw when burned produces an amount of energy substantially equal to that of 0.36 liters of fuel oil. Thus one large round bale of straw of about 500 kg will produce as much energy when burned as about 180 liters of fuel oil. Waste wood, for example brushwood, when burned will also produce about the same amount of energy per unit of weight as straw. In times of a constantly increasing energy shortage the utilization of such waste materials to produce energy is of increasing importance.

Such wastes are amply available from various agricultural and forestry operations. No appreciable transport costs are involved. On the other hand, considerable heat is required by many agricultural operations. For example, large amounts of heat are necessary for drying grain such as corn and green fodder and also for the heating of large areas such as barns and other livestock housing. Thus the need for furnaces suitable for burning agricultural and forest waste is particularly important.

A furnace adapted for burning such waste materials and particularly for the combustion of large straw bales is already known. This furnace is provided with a fan which is connected to an afterburning compartment through a socket for drawing off completely burned gases. The temperature of the burned gases flowing out of the afterburning compartment through the fan is about 800° C. The fan can only withstand such high temperatures for a short time. Accordingly, it has been found, in practice, that after only a comparatively short operating time, the fan of the known furnace is destroyed so the furnace is not of any practical value.

The feed hopper of the known furnace has a cylindrical shape which is closed at the bottom with a bottom member and at the top only with a cover. Therefore, it is impossible to replenish the fuel bed with material such as large straw bales while the furnace is in operation. Before refilling the furnace, it is necessary to burn the charge completely and to allow the furnace to cool down. The furnace therefore has to be closed down comparatively often and for a long time, which may likewise be undesirable.

In the known furnace, the supply of primary combustion air is effected through lateral apertures in the wall of the feed hopper, which are in communication with the atmosphere. The apertures can be closed, for example by stoppers, in order to regulate the amount of primary combustion air to be supplied. In order to draw off the combustion gases and incompletely burned gases in the afterburning compartment, an aperture disposed axially in relation to the feed hopper is provided below the combustion and low-temperature carbonization region above the afterburning compartment. This aperture is covered with a hood to prevent ash from entering the afterburning compartment.

The primary combustion air flows preferably from the lateral apertures in the wall of the feed hopper towards the central disposed above the combustion chamber and covered with a hood. In order that the primary combustion air will flow through the lower portion of the charge, that is to say, will flow through the combustion and low-temperature carbonization region over as long a path as possible on its way from the lateral apertures to the central aperture, the lateral apertures are provided above the combustion and low-temperature carbonization region in the wall of the feed hopper. Consequently, at the beginning of operation of the furnace, the lateral, lower portion of the charge burns away comparatively quickly so that a cone of unburned fuel or straw forms, the downwardly directed tip of which lies over the hood disposed over the offtake aperture, as a result of which further burning of the charge at this point is rendered difficult. This leads, as a further advantage of the known furnace, to the fact that great fluctuations occur in the heating capacity during the starting operation.

It is an object of this invention to provide an improved furnace for burning waste materials.

Another object of the invention is to provide a furnace particularly well suited for burning such materials as straw, brushwood and the like.

The foregoing objects and others are accomplished in accordance with the invention generally speaking, by providing a furnace with an afterburning compartment, apparatus for supplying air to the afterburning compartment, a suction tube for withdrawing combustion products from the afterburning compartment which has an area reduced cross-section and a source of compressed air or other fluid such as a nozzle which discharges a compressed fluid into the area of reduced cross-section in the direction the combustion products are flowing.

The following advantages are achieved by the invention:

the nozzle provided in the suction tube and which is acted upon by fast-flowing gas, for example by compressed air produced by a compressor, is insensitive to heat with respect to the temperatures of the gas drawn off and flowing to the consumer device. Operational disturbances as a result of the offtake device are therefore eliminated in the furnace according to the invention.

Replenishment of fuel is insured even during the burning, as the fuel slides in the feed hopper. Moreover, uniform burning of the lower portion of the charge is insured by the apertures distributed over the whole periphery of the feed hopper, disposed at the height of the combustion and low-temperature carbonization region and charged with compressed air as well as by the apertures disposed in the tip of each supporting piller and likewise charged with compressed air.

Figure 2:
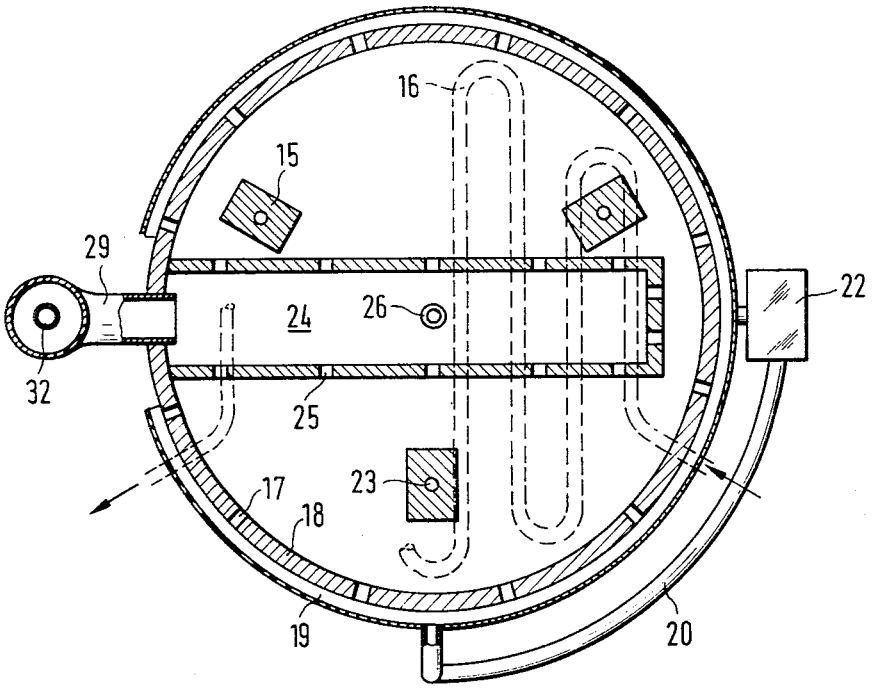

The invention is explained by way of example below, with reference to the accompanying drawing. In the drawing which illustrates one embodiment of the invention diagrammatically:

FIG. 1 shows a side view of an embodiment of a furnace provided by the invention with the wall of the feed hopper partially broken away; and FIG. 2 shows a section through the furnace along the line I—I of FIG. 1.

According to FIG. 1, the furnace provided by the invention has a feed hopper 1 which may be a sheet-metal cylindrical member and a lower widened portion which represents a combustion chamber 2. The feed hopper 1 is closed at the bottom by a bottom member 3 made of refractory brick, for example fireclay, and at the top by a cover 4.

The cover 4 can be actuated by a cable 7 taken over a guide pulley 6 secured to a jib 5. It is pivotally mounted by a spindle 8 on the upper end of the feed hopper 1.

Between the combustion chamber 2 and the cover 4, at about half the height of the feed hopper 1, a slide member 9 is provided which is illustrated in broken lines in FIG. 1 and the diameter of which corresponds to the internal diameter of the feed hopper 1 so that when the cover 4 is open, the combustion chamber 2 can be closed at the top by the slide member 9. The slide member 9 travels on a guide rail 11 by means of rollers 10 secured thereto and is actuated by a chain 14 acting on the slide member 9 at 13 and guided by a guide roller 12 secured to the feed hopper 1, for example by means of an electric motor not illustrated.

A plurality of pillars 15 are disposed at the bottom 3 of the feed hopper 1 to receive pressed waste fuels, such as large round bales of straw or the like. The pillars 15 are made of refractory brick such as fireclay. Instead of or in addition to the pillars 15, a coil of pipe 16 (FIG. 2) can extend over the whole cross-section of the feed hopper 1, through which a coolant, particularly water, flows, as indicated diagrammatically by the two arrows in FIG. 2. The coil of pipe 16 serves to receive loose waste fuels, that is to say those which are not pressed, such as brushwood, bark or split firewood.

The pillars 15 extend almost to the height of apertures 17 in the side wall 18, likewise made of refractory brick, for example fireclay, of the combustion chamber 2 of the feed hopper 1. If the coil of pipe 16 is provided, it is at the same height as the upper ends of the pillars 15.

The primary combustion air is supplied to the combustion and low-temperature carbonization region in the combustion chamber 2 through the apertures 17 in the side wall 18 of the combustion chamber 2. For this purpose, the apertures 17 are connected to a ring conduit 19 which is taken externally around the feed hopper 1 or the combustion chamber 2 and is in communication with a source of compressed air 22, for example a compressor, through a conduit 20 and a branch pipe 21.

The pillars 15 are each provided with a point at their upper end. The charge, for example, the straw bales introduced into the feed hopper 1, rests on these points. Thus regions where the supply of primary combustion air is rendered difficult develop at the points of contact between the straw bales and the points of the pillars 15. It has therefore proved advantageous to provide apertures 23 at the points of the pillars 15, through which apertures the primary combustion air flows to the combustion and low-temperature carbonization region in the combustion chamber 2. The apertures 23 in the pillars 15 may likewise be connected to the source of compressed air 22 through conduits not illustrated.

An afterburning compartment formed by a passage 24 is disposed immediately above the bottom of the feed hopper 1 or of the combustion chamber 2. The wall of the passage 24 likewise consists of refractory brick, such as fireclay. It extends substantially over the whole width of the bottom 3 and is provided with lateral slits 25.

A conduit 27 leads into the middle of the bottom 3 of the combustion chamber 2 through an aperture 26. The secondary combustion air is supplied to the afterburning compartment or the passage 24 through the conduit 27, via the branch 21 from the source of compressed air 22. In order to be able to regulate the throughput of compressed air for the secondary combustion air, a slide member or valve 28 is provided in the conduit 27. Such a slide member or such a valve may appropriate also precede the conduit 20 to the ring conduit 19 but is not illustrated in the drawing.

A suction tube 29, through which the gases completely burned in the afterburning compartment are supplied to the consumer device projects through the side wall 18 of the combustion chamber 2 into the afterburning compartment or the passage 24. For this purpose, the suction tube 29 comprises a constricted section 30. A fast flowing gas, for example compressed air, is supplied to the constricted section 30 through a nozzle 31 disposed coaxially in the suction tube 29, in the direction of the outflowing gases, which is represented by an arrow in FIG. 1, the gas being supplied through a conduit 32 which may be connected to a compressor, not illustrated. The gas, such as compressed air, flowing through the nozzle 31 entrains the burned gases present in the suction tube 29 and in this manner produces a reduced pressure in the combustion chamber or passage 24, which leads to the drawing off of the combustion gas and incompletely burned gases formed in the combustion chamber 2 into the combustion chamber or passage 24.

In operation, the furnace work as follows:

After the cover 4 has been opened and the slide member 9 has been drawn out of the filling space 1, the filling space 1 is filled with two large round bales of straw, or the like. After setting fire to them, a primary combustion air is supplied through the apertures 17 and possibly 23 to the combustion chamber 2 and secondary combustion air is supplied through the aperture 26 to the afterburning compartment or passage 24. A fast flowing gas is also admitted to the nozzle 31.

A combustion and low-temperature carbonization region develops above the pillars 15 or the coil of pipe 16, and pyrolignite, phenols or other combustible gases are driven out of the fuel by the heat. As a result of the suction produced by the nozzle 31, these incompletely burned gases or vapors are drawn through the apertures 25 into the afterburning compartment or into the passage 24.

The afterburning then takes place in the passage 24 and can be controlled by adjusting the supply of compressed air by means of the valve or slide member 28. The completely burned gases then flow through the suction tube 29 to a consumer device, for example, a grain drying installation.

At the same time, the waste fuel drops down in the feed hopper. As soon as the charge, for example the upper of the two large round bales of straw, has sunk below the height of the slide member 9, the combustion chamber 2 is shut off from the upper section of the feed hopper 1 by the slide member 9, the cover 4 is opened, the upper section of the feed hopper 1 above the slide member 9 is filled with a fresh charge, for example a fresh large round bale of straw, then the cover 4 is closed and after the slide member 9 has been pulled out of the feed hopper 1, the fresh charge enters the combustion chamber 2. In this manner, the furnace according to the invention can be filled continuously that is to say it does not have to be stopped.

In order to able to determine when the charge has sunk below the height of the slide member 9, an indicating device is provided below the slide member 9 on the feed hopper 1. This consists essentially of a bell-crank lever which is articulated on the feed hopper 1 and of which the first lever arm 33, represented in broken lines in FIG. 1, is disposed in the feed hopper 1 and of which the first lever arm 33, represented in broken lines in FIG. 1, is disposed in the feed hopper 1 and of which the second lever arm 34, extending from the feed hopper 1, carries a restoring weight 35.

If the lever arm 33 is loaded, that is to say there is fuel present at the height of the lever arm 33, then the lever arm 33 extends downwards with its free end between fuel and the wall of the combustion chamber 2, while the second lever arm 34 with the restoring weight 35 extends substantially horizontally away from the feed hopper 1. On the other hand, if there is no fuel in the combustion chamber 2 at the height of the lever arm 33, then the lever arm 33 projects horizontally into the feed hopper 1 and the lever arm 34 with the restoring weight 35 projects downwards. Thus the position of the lever arm 34 disposed externally on the feed hopper 1 or of the weight 35 indicates whether or not there is fuel at the height of the lever arm 33 in the interior of the feed hopper 1.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. A furnace for burning bales of straw, comprising an afterburning compartment, a closeable feed hopper for receiving the bales of straw disposed above said compartment, said afterburning compartment comprising a passage which extends substantially over the whole width of the feed hopper and which comprises lateral apertures distributed over its whole length for receiving combustible gases, a device for supplying primary combustion air to a combustion and low-temperature carbonization region situated immediately above the afterburning compartment, a device for supplying secondary combustion air to the afterburning compartment, a device connected to the afterburning compartment for drawing off gases which enter said lateral apertures formed in the combustion and low-temperature carbonization region by burning the bales of straw comprising a suction tube connected to said afterburning compartment having a constricted section and a nozzle disposed in the suction tube for delivering a fast flowing gas to the suction tube in the direction of the outflowing gases.

2. The furnace of claim 1, wherein a horizontal ring conduit extends around the feed hopper to supply the primary combustion air, and is connected on the one hand to a source of compressed air and on the other hand, through apertures distributed over the whole periphery of the ring conduit and directed towards the combustion and low-temperature carbonization region, to the interior of the feed hopper, and means for regulating the throughput of compressed air.

3. The furnace of claim 2, further comprising at least one pillar which extends substantially up to the height of the apertures in the ring conduit and is disposed at the lower end of the interior of the feed hopper to receive the straw bales.

4. The furnace of claim 3, wherein said pillar is provided at its upper end with a point which comprises an aperture through which compressed primary combustion air is supplied to the combustion and low-temperature carbonization region.

5. The furnace of claim 2 for loose, unpressed waste fuel further comprising a horizontal coil of pipe which extends substantially over the whole cross-section of the feed hopper and through which a coolant flows disposed in the interior of the feed hopper at the height of the said apertures in the ring conduit.

6. The furnace of claim 1, wherein a slide member is disposed horizontally, and extends over the whole cross-section of the feed hopper with spacing above the combustion and low-temperature carbonization region.

7. The furnace of claim 6, wherein the slide member is disposed substantially in the middle between the combustion and low-temperature carbonization region and the upper, closeable end of the feed hopper.

8. The furnace of claim 6 wherein a bell-crank lever is articulated below the slide member having a first lever arm disposed in the feed hopper and a second lever arm which extends out of the feed hopper carrying a restoring weight, said first lever arm when loaded with waste fuel extending downwards with its free end and the second lever arm with the restoring weight extending substantially horizontally away from the feed hopper, while in the unloaded state, the first lever arm projecting horizontally into the feed hopper and the second lever arm with the restoring weight projecting downwards with its free end.

9. A furnace adapted for burning bales of straw which comprises a housing including a bottom member enclosing a combustion chamber, a feed hopper disposed above the combustion chamber, a slidable partitioning member disposed between the hopper and chamber, means for sliding the said member into open and closed positions, means for supporting bales of straw in the combustion chamber spaced upwardly from the said bottom member comprising pillars having conical tops with holes in the apexes and means for connecting the pillars to a source of compressed air whereby air flows through the holes in the apexes to burning fuel supported thereon, means for admitting air under pressure through said housing into the chamber adjacent to the said bottom member, and means for withdrawing combustion gases from said chamber near said bottom member, said withdrawing means comprising a first conduit having a wall which is constricted at one point to reduce the cross-section of the conduit in one region, a second conduit connected at one end to a source of compressed air and terminating in a nozzle in the first conduit adjacent to the said region of reduced cross-section, said nozzle being disposed to direct compressed air flowing therethrough in the downstream direction of said withdrawn gases.

10. A furnace for burning bales of straw comprising:

a closeable feed hopper for receiving the bales of straw;

an afterburning compartment located at the bottom of said hopper, said compartment being formed from a passage extending the width of the feed hopper, said compartment containing lateral apertures distributed over its whole length whereby combustible gases may pass;

means for supporting a bale of straw above the afterburning compartment comprising at least one pillar extending vertically upward from the bottom of said hopper to a point above said afterburning compartment;

means for supplying primary combustion air to a combustion and low temperature carbonization region situated above said afterburning compartment;

means for supplying secondary air to the afterburning compartment; and a suction tube having a constricted section, and a nozzle disposed therein for delivering a fast flowing gas to the suction tube; said suction tube having one end connected to said afterburning compartment for removing gasses from said compartment.

11. The furnace of claim 10, wherein said pillar is provided at its top with an aperture connected to a source of air for delivering a stream of air to the underside of a bale of straw.

* * * * *